US006435371B1

(12) United States Patent
Perrins

(10) Patent No.: US 6,435,371 B1
(45) Date of Patent: Aug. 20, 2002

(54) INFLATION DEVICE

(75) Inventor: John Perrins, Alton (GB)

(73) Assignee: United Moulders, Limited, Hants (GB)

( * ) Notice: Subject to any disclaimer, the term of this patent is extended or adjusted under 35 U.S.C. 154(b) by 0 days.

(21) Appl. No.: 09/786,689

(22) PCT Filed: Sep. 6, 1999

(86) PCT No.: PCT/IB99/01509

§ 371 (c)(1),
(2), (4) Date: Apr. 23, 2001

(87) PCT Pub. No.: WO00/15493

PCT Pub. Date: Mar. 23, 2000

(30) Foreign Application Priority Data

Sep. 10, 1998 (GB) ..... 9819698

(51) Int. Cl.[7] ..... B63C 9/19; F16K 31/00
(52) U.S. Cl. ..... 222/5; 222/54; 441/95
(58) Field of Search ..... 222/5, 54; 441/95

(56) References Cited

U.S. PATENT DOCUMENTS

| | | | | |
|---|---|---|---|---|
| 3,048,303 A | * | 8/1962 | Spidy et al. | 222/5 |
| 3,266,668 A | | 8/1966 | Davis | 222/5 |
| 3,526,339 A | | 9/1970 | Bernhardt et al. | 222/5 |
| 3,934,292 A | | 1/1976 | Mulderrig | 222/5 |
| 4,475,664 A | | 10/1984 | Mackal | 222/5 |
| 5,601,124 A | | 2/1997 | Weinheimer et al. | 141/19 |

FOREIGN PATENT DOCUMENTS

| | | |
|---|---|---|
| DE | 1117433 | 11/1961 |
| FR | 1147137 | 7/1959 |
| GB | 2 278 911 A | 12/1994 |

* cited by examiner

*Primary Examiner*—J. Casimer Jacyna
(74) *Attorney, Agent, or Firm*—Oliff & Berridge, PLC

(57) ABSTRACT

An inflation device (5) for an inflatable article (such a life jacket), includes a housing (8) for holding a container of pressurised fluid (6), a displacement means (12) including a piercing means (15) displaceable so as to penetrate the container (6) and allow the release of said pressurised fluid, and actuation means (23, 27, 28, 29) having engaging co-operating elements (17, 25) which engage to retain the displacement means (12) in an unactuated configuration. The actuation means (23, 27, 28, 29) release the displacement means (12) both through the presence of water or by manual operation. The co-operating elements (17, 25) are substantially radially arranged. The line along which the displacement means (12) acts may be coaxial with the radii of the co-operating elements (17, 25). One of the co-operating elements (17) is capable of inward radial movement, and the actuation means (27, 28, 29) operates to prevent that co-operating element's (17) radially inward movement. Similarly, one of the co-operating elements (25) is capable of outward radial movement, and also prevented by the actuating means (23). When the actuation moms (23, 27, 28, 29) is triggered (by water or by the manual release), the movement of one of the co-operating elements (17, 25) causes the displacement means (12, 15) to pierce the container.

13 Claims, 1 Drawing Sheet

INFLATION DEVICE

BACKGROUND OF THE INVENTION

1. Field of the Invention

This invention relates to an inflation device and, in particular, to an inflation device for lifejackets and the like which is capable of both manual and automatic actuation. Such devices are known in the art as Autoinflators.

Various examples of autoinflator are known, one example being that shown in U.S. Pat. No. 5,601,124. This patent describes a device in which the automatic and manual actuators rely on different sets of components, with the result that there is a relatively large number of operating parts. This, in turn, influences cost and raises potential reliability issues.

2. Description of Related Art

GB 2 278 911 (Mackel) discloses an autoinflator in which a cammed arm is capable of driving a puncture pin into a gas cylinder. The arm is held in repose by a torsion spring around the pivot, but is connected to a lanyard at the end of the arm. Pulling the lanyard with sufficient force to overcome the torsion spring causes the arm to rotate and so drive the pin into the gas container.

The lanyard is also connected to a slidable member itself attached to a spring. The spring has a tendency to pull the slidable member, so operating the lanyard, but the slidable member is held in place by a retaining pin, transverse to the line of sliding. A soluble element holds the retaining pin in position, the soluble element being firmly held against the retaining pin by a resilient member. The dissolution of the soluble element causes the pin to disengage from the slidable member, and so causes the inflation of the device. If the lanyard is pulled with sufficient force it will overcome the retaining pin and cause inflation.

Though that apparatus requires fewer parts than autoinflators having distinct manual and water-activated mechanisms, it is still has many components capable of failure. The device may also be difficult to activate manually, since the retaining pin must be held firmly enough to disallow the tension spring to activate the device whilst the soluble member is still integral.

It is an object of this invention to provide an inflation device which has a lesser number of operating parts than typical prior art inflator devices or which will at least provide a useful choice.

SUMMARY OF THE INVENTION

Accordingly, the present invention provides for an inflation device for an inflatable article, said inflation device including:

a housing adapted to hold a container of pressurised fluid;

a displacement means including a piercing means displaceable so as to penetrate a container held by the housing and allow the release of said pressurised fluid;

actuation means having engaging co-operating elements which engage to retain the displacement means in an unactuated configuration, the actuation means releasing the displacement means both through the presence of water and by manual operation, said co-operating elements being substantially radially arranged, one of the co-operating elements is capable of movement in a substantially radially outward direction, said actuation mew being operable to prevent the co-operating element's movement, and one of the co-operating elements is capable of movement in a substantially radially inward direction, said actuation means being operable to prevent that co-operating element's movement each co-operating element being the operable and movable separately to and independently of the other. Preferably the line along which the displacement means acts is coaxial with the radii of the co-operating elements.

Preferably the manually operable release means includes a plug which, in the unactuated configuration, prevents movement of the co-operating sections.

Preferably the water actuable release maw include a water sensitive sleeve which, in the unactuated configuration, surrounds and restrains the co-operating sections against movement but which, when immersed in water, degrades ad permits movement.

According to another aspect of the present invention there is provided an inflation device for an inflatable article, said inflation device including:

a housing for holding a container of pressurised fluid;

a displacement means including a piercing means displaceable so as to penetrate the container and allow the release of said pressurised fluid;

actuation means having engaging co-operating elements which engage to retain the displacement means in an unactuated configuration, the actuation means releasing the displacement means both through the presence of water by it water-sensitive control element, and through manual operation by a manual control element, the actuation means including a retaining element having two retaining surfaces at an angle to each other, one surface bearing against the water-sensitive control element and the other against the manual control element, whereby an release of either control element, the retaining element slides put the other control element.

In the preferred embodiment described herein, the water actuable release means comprises a water sensitive sleeve which, in the cocked configuration, surrounds and restrains the co-operating sections against radially outward movement but which, when immersed in water, degrades and permits radially outward movement. The manually operable release means includes a plug which, in the cocked configuration, prevents radially inward movement of the co-operating sections. Manual removal of the plug permits inward movement and to release of the displacement spring.

It will be seen that since the coiled spring directly urges the piercing means forward, a linkage to convert the direction of the displacement means, such as the cammed arm in Mackel, is unnecessary. Because of this, and the coaxial arrangement of the components, fewer parts are needed, making the device less expensive to produce, and more compact and reliable.

That the force which disengages the co-operating elements is transverse to the force exerted by the restrained displacement means, whether activated manually or by the presence of water, allows, say, a large force (which may be necessary in order to pierce the pressurised container) to be initiated by a relatively small force applied manually. The force to activate the mechanism, and the force to pierce the container may be set independently to the optimum magnitudes.

Many variations in the way the present invention might be performed will present themselves to those skilled in the art. The description which follows is intended only as an illustration and the absence of description of particular alternatives or variants should in no way be applied to limit the scope of the invention. Such description of specific, elements which follows should also be interpreted as including equivalents whether existing now or in the future. The scope of the invention should be determined solely by the appended claims.

BRIEF DESCRIPTION OF THE DRAWINGS

An inflation device according to the invention will now be described, by way of example, with reference to the accompanying drawings which.

DETAILED DESCRIPTION OF THE PREFERRED EMBODIMENTS

Figure 1:
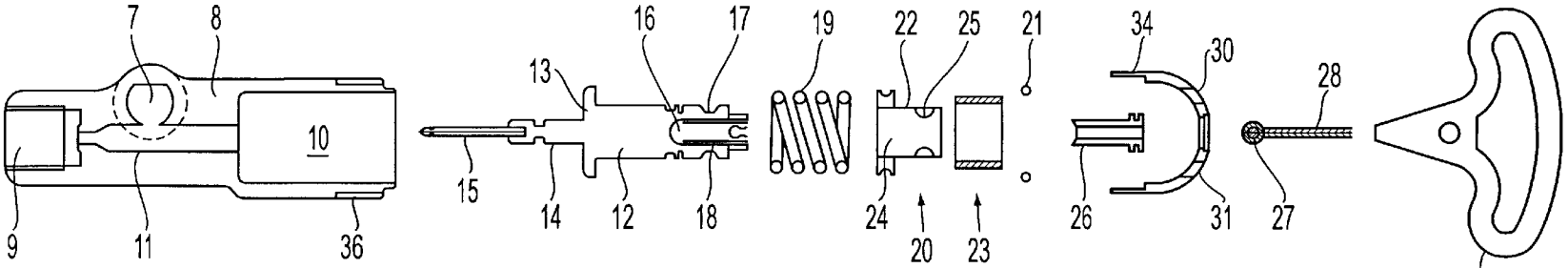
FIG. 1 shows an exploded longitudinal section, of the principal components forming an inflation device according to the invention

Referring to the drawings, the invention provides an inflation device 5 for inflating an inflatable article such as a lifejacket or the like (not shown). In essence, this involve the timely release of pressurised fluid, preferably pressurised gas, from a pressurised gas capsule 6 and delivery of that go to an outlet port 7. When mounted on an inflatable article, the port 7 is placed in sealing communication with the chamber in the article which is to receive the pressurised gas.

As can be seen, the device 5 includes a main body 8 which, in addition to carrying outlet port 7, has a cavity 9 at its forward end to receive the neck of a gas capsule 6, and a further cavity 10, at its rear end, to receive the other operating components as will be described below. A through bore 11 places the cavity 10 in communication with the cavity 9.

A piston 12, having an annular collar 13, is mounted within the cavity 10. The piston 12 includes a central spigot 14 forward of the collar 13. The spigot 14 is a sliding fit within the through bore 11 and serves as a mount for piercing means in the form of knife 15. The knife is normally located within through bore 11 but is sized and configured so that the forward, or pointed, end can be displaced into cavity 9 so as to pierce a surface part of capsule 6.

Located on the rear end of the piston 12 is a split skirt having an inner bore 16 and a circumferential groove 17 about the outer surface. Longitudinal slits 18 impart a degree of flexibility to the skirt 16 and permit inward and outward radial displacement or deformation of the skirt.

A coil displacement spring 19 fits about the outer surface of the piston 12, one end of the spring acting against the collar 13. The rear end of the spring 19 bears against a collet 20 which is retained in position within the cavity 10 by means of pins 21.

The collet 20 is a further substantially cylindrical member, the rear part of which is defined by an axially split outer cylindrical surface 22 sized to receive thereon, and be held in shape by, paper fuse sleeve 23. The axial slits (not shown) which extend longitudinally of surface 22 allow displacement or deformation of the surface 22 in a radial direction. Collet 20 also includes a central bore 24 which includes a radially inward lip 25 extending circumferentially around the bore 24. The lip is configured to cooperate and engage with groove 17 on the piston 12.

A manual release rod 26, locates in the inner bore 16 of the piston. The release rod 26 not only serves to prevent inward collapse of the skirt 16 but also traps ball 27 formed on the inner end of pull cord 28. The outer end of pull cord 28 is fixed to pull handle 29.

Finally, end cap 30 clips onto the outer end of release rod 26 and mates with the rear edge of cavity 10 to close the cavity, prevent casual exposure to the paper fuse 23, and impart a finished appearance to the device. Cap 30 includes ports 31 so that, when the device is immersed in water, water may flow through the ports 31 and saturate the fuse 23.

Figure 2:
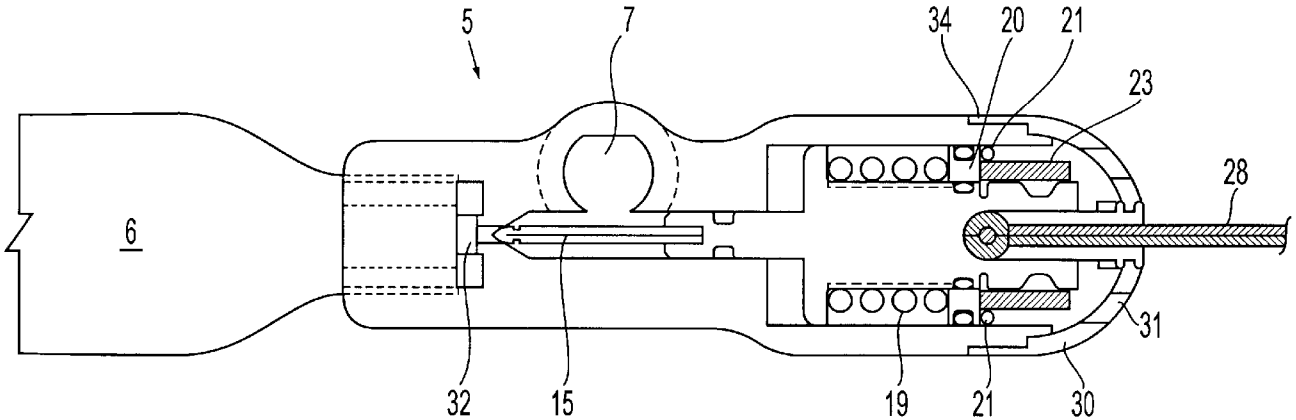
FIG. 2 shows the components of FIG. 1, in a larger scale, assembled together into an inflation device.

The assembled device is shown in the cocked configuration in FIG. 2. In this form, the spring 19 is compressed between the collet 20 and the collar 13 of piston 12. However, the piston is restrained against movement by the radial inter-engagement of lip 25 and groove 17. The force of spring 19 is such as to disengage lip 25 and groove 17 but disengagement is prevented by a combination of the paper fuse 23 and the manual release rod 26.

Upon the paper fuse 23 becoming immersed in water, the sleeve degrades allowing spring pressure to deform skirt section 22 outwardly and, in turn, forcing lip 25 out of groove 17. The full force of spring 19 is then applied to displace the piston, with attached knife, to the left as shown in the drawings, whereupon the knife 15 is driven through seal 32 over the neck of the capsule 6. This action releases the pressurised gas.

If it is desired to activate the device 5 manually, the handle 29 is grasped and pulled in a direction away from the remainder of the device. This action withdraws the release rod 26 from the bore 16 and allows the piston skirt to deform inwardly under the force of spring 19. Once again, this leads to disengagement of lip 25 from groove 17 and permits the full force of the spring 19 to be applied to the displacement of piston 12 and knife 15.

The skirt 16, in the actuated position, has two elements constraining its movement, the collet 22 by the collet's lips engagement with the groove 17 in the skirts outer surface, and the plug 26 pressing against the skirts inner surface. The lips of the collet 22 bear against the sloping rear surface of the groove 17 forming part of the outer surface or boundary of the skirt 16; the plug 26 bears against the inner surface or boundary of the bore of the skirt 22. Removal of constraint by either of these controlling elements allows the skirt to slide past the other element.

The cap 30 includes legs which extend inwardly of the device and co-operate with corresponding slots 34 in the main body 8 when the device is in the assembled state. The slots 34 provide an information bearing surface comprising warnings such as "DO NOT USE", "DISPOSE IMMEDIATELY" or "RETURN TO SUPPLIER" or some similar legend, which are visible when the device is disassembled, for example after use and the cap is separated from the body. This is a safety measure to ensure that spent gas capsules are not used by mistake which would result in failure of the device when required. In the present embodiment a pair of legs 34 are provided co-operating with a pair of slots 34 so that two warnings can be provided on opposite sides of the device, although it will be appreciated that any arrangement of the legs and slots could be used to produce the desired result.

It will thus be appreciated that the present invention provides an inflation device which is capable of both manual and automatic actuation yet which combines both forms of actuation in with relatively few and simple components.

Many variations using the principles herein disclosed are possible. In particular, the co-operating elements of the preferred embodiment, the radial lip 25 and the radial groove 17, may subject to much variation of configuration without altering their function. Naturally, the lip and groove may be transposed, so that the collet includes a groove and the skirt a lip. Other types of catch mechanism may be used for the co-operating parts with the necessary modifications. The method of effecting the manual release could equally be effected by engaging co-operating elements, in which case the water-sensitive release could be effected by a simple removable constraining surface.

What is claimed is:

1. An inflation device for an inflatable article, said inflation device including:

a housing adapted to hold a container of pressurised fluid;

a displacement mum including a piercing means displaceable so as to penetrate a container held by the, housing and allow the release of said pressurised fluid;

actuation means having engaging co-operating elements which engage to retain the displacement means in an unactuated configuration, the actuation mews releasing the displacement means both through the presence of water and by manual operation, said co-operating elements being substantially, readily arranged, one of the co-operating elements is capable of movement in a substantially radially outward direction, said actuation means being operable to prevent that co-operating element's movement, and one of the co-operating elements is capable of movement in a substantially radially inward direction, said actuation means being operable to prevent that co-operating element's movement, each co-operating element being the operable and movable separately to and independently of the other.

2. A device according to claim 1, wherein the line along which the displacement means acts is coaxial with the radii of the a co-operating elements.

3. A device according to claim 2, wherein the manually operable release means includes a plug which, in the actuated configuration, prevents movement of the co-operating sections.

4. A device according to claim 2, wherein the water actuable release means include a water sensitive sleeve which, in the actuated configuration, surrounds and restrains the co-operating sections against movement but which, when immersed in water, degrades and permits movement.

5. An inflation device according to claim 2 wherein there is included a container of pressurised fluid.

6. A device according to claim 1, wherein the manually operable release means includes a plug which, in the unactuated configuration, prevents movement of the co-operating sections.

7. A device according to claim 6, wherein the water actuable release means include a water sensitive sleeve which, in the actuated configuration, surrounds and restrains the co-operating sections against movement but which, when immersed in water, degrades and permits movement.

8. An inflation device according to claim 6 wherein there is included a container of pressurised fluid.

9. A device according to claim 1, wherein the water actuable release means include a water sensitive sleeve which, in the actuated configuration, surrounds and restrains the co-operating sections against movement but which, when immersed in water, degrades and permits movement.

10. An inflation device according to claim 9 herein there is included a container of pressurised fluid.

11. An inflation device according to claim 1 wherein there is included a container of pressurised fluid.

12. An inflation device for an inflatable article, said inflation device including:

a housing for holding a container of pressurised fluid;

a displacement means including a piercing means displaceable so as to penetrate the container and allow the release of said pressurised fluid;

actuation means having engaging co-operating elements which engage to retain the displacement means in an unactuated configuration, the actuation means releasing the displacement means both through the presence of water by a water-sensitive control element and through manual operation, by a manual control element, the actuation means including a retaining element having two retaining surfaces at an angle to each other, one surface bearing against the water-sensitive control element mid the other against the manual control element, whereby on release of either control element, the retaining element slides past the other control element.

13. An inflation device according to claim 12 wherein there is included a container of pressurised fluid.

* * * * *

UNITED STATES PATENT AND TRADEMARK OFFICE

CERTIFICATE OF CORRECTION

PATENT NO. : 6,435,371 B1
DATED : August 20, 2002
INVENTOR(S) : John Perrins

It is certified that error appears in the above-identified patent and that said Letters Patent is hereby corrected as shown below:

Column 5,
Line 11, change “mum” to -- means --;
Line 12, delete “,”;
Line 16, change “mews” to -- means --;
Line 19, change “readily” to -- radially --.
Line 32, delete “a”.
Lines 34-35 and 40, change “actuated” to -- unactuated --.

Column 6,
Lines 7 and 14, change “actuated” to -- unactuated --.
Line 17, change “herein” to -- wherein --.
Line 31, after “element” insert -- , --;
Line 36, change “mid” to -- and --.

Signed and Sealed this

Eleventh Day of February, 2003

JAMES E. ROGAN
*Director of the United States Patent and Trademark Office*